US006171362B1

(12) United States Patent
Osumi et al.

(10) Patent No.: US 6,171,362 B1
(45) Date of Patent: Jan. 9, 2001

(54) METHOD FOR REFINING MOLTEN ALUMINUM ALLOY AND FLUX FOR REFINING MOLTEN ALUMINUM ALLOY

(75) Inventors: Kenji Osumi, Kobe; Takayuki Kitano, Shimonoseki; Kazuhisa Fujisawa, Kobe, all of (JP)

(73) Assignee: Kobe Steel, Ltd, Kobe (JP)

( * ) Notice: Under 35 U.S.C. 154(b), the term of this patent shall be extended for 0 days.

(21) Appl. No.: 09/468,877

(22) Filed: Dec. 22, 1999

(30) Foreign Application Priority Data

Dec. 25, 1998 (JP) ..... 10-370427
Dec. 13, 1999 (JP) ..... 11-352813

(51) Int. Cl.[7] ..... C22B 3/34

(52) U.S. Cl. ..... 75/305; 75/327; 75/329; 164/56.1; 164/473

(58) Field of Search ..... 75/305, 327, 329; 164/472, 473, 56.1

(56) References Cited

U.S. PATENT DOCUMENTS 5,304,231 * 4/1994 Kato et al. ..... 75/528

FOREIGN PATENT DOCUMENTS 53-37512 * 4/1978 (JP) .
54-48621 * 4/1979 (JP) .
57-09846 * 1/1982 (JP) .
61-243136 10/1986 (JP) .
62-37329 * 2/1987 (JP) .
1-123035 5/1989 (JP) .
5-202434 8/1993 (JP) .
5-209237 8/1993 (JP) .
5-331568 12/1993 (JP) .
6-299263 10/1994 (JP) .
7-90409 4/1995 (JP) .
7-207367 * 8/1995 (JP) .
7-207355 8/1995 (JP) .
7-207358 8/1995 (JP) .
7-207359 8/1995 (JP) .
7-207360 8/1995 (JP) .
7-207374 8/1995 (JP) .
7-207376 8/1995 (JP) .
7-242957 9/1995 (JP) .
8-67924 3/1996 (JP) .
8-81720 3/1996 (JP) .
8-85832 4/1996 (JP) .
8-120359 5/1996 (JP) .
8-120360 5/1996 (JP) .
8-295958 11/1996 (JP) .
8-295959 11/1996 (JP) .
8-295961 11/1996 (JP) .
9-31562 2/1997 (JP) .
11-80851 * 3/1999 (JP) .

* cited by examiner

*Primary Examiner*—George Wyszomierski
*Assistant Examiner*—Janelle Combs Morillo
(74) *Attorney, Agent, or Firm*—Oblon, Spivak, McClelland, Maier & Neustadt, P.C.

(57) ABSTRACT

A method for refining molten Al alloy and a non-halogen based flux for refining molten Al alloy which make it possible to perform refining such as removal of gas and inclusions at a high reduction level, and are free from a problem that the flux remains in the molten Al alloy, wherein a refining flux is injected into molten Al alloy obtained by melting an Al raw material to refine the melt, thereafter, the resultant is supplied to a mold, so as to cast the Al alloy. At this time, alum is used as the refining flux.

13 Claims, No Drawings

METHOD FOR REFINING MOLTEN ALUMINUM ALLOY AND FLUX FOR REFINING MOLTEN ALUMINUM ALLOY

FIELD OF THE INVENTION

The present invention relates to a method for refining a melt of pure aluminum or an aluminum alloy (referred to as an Al alloy hereinafter), and a flux for refining a melt of an Al alloy (i.e., a molten Al alloy).

RELATED ART

As is well known, Al alloy products such as sheets and plates, shapes, wire rods or rods are produced by subjecting cast Al alloy ingots to plastic working such as rolling (hot rolling or cold rolling), extrusion or forging.

In the melting or casting step for the Al alloy ingots, an Al raw material (a Al base metal, scrap of Al alloy products, or the like) is usually melted in a melting furnace, and then components of the melt are adjusted to refine the molten Al alloy. The refining of this molten Al alloy (which may be referred to as the molten Al hereinafter) is a process for cleaning the melt, which comprises, for example, the steps of injecting chlorine gas, or a chlorine-based flux together with an inert gas as a carrier gas, into the melt; removing gas components from the melt or making inclusions therein to slag; and removing the slag from the surface of the molten Al. The refined molten Al from the melting furnace is, with or without passage thereof through a holding furnace, supplied through respective launders to a mold. When the refined Al melt flows down through the launders, the inclusions are further removed with a filter fitted to the launder or a filter box immediately before the mold. In such a way, the refined Al melt is supplied to the mold and cast into an Al alloy ingot.

The gas such as $H_2$ gas in the melt is removed by chlorine gas according to the following mechanism. That is, $Cl_2$ injected into the melt is reacted with the molten Al to produce $AlCl_3$. This produced $AlCl_3$ is sublimated from solid to gas to turn into gas bubbles which are smaller than the injected $Cl_2$ gas bubbles. The partial pressure of $H_2$ in the gas bubbles is substantially zero. Therefore, $H_2$ gas in the melt transfers from the melt to the $AlCl_3$ gas bubbles by diffusion and particle pressure equilibrium. The fine $AlCl_3$ gas bubbles float up to the surface of the melt and volatilize to remove $H_2$ from the melt.

The removal of the inclusions in the melt is performed by mutual adhesion between the $AlCl_3$ gas bubbles and the inclusion. The mutual adhesion is based on the phenomenon that the AlCl3 gas bubbles adhere to the inclusions and smaller inclusions adhere to the $AlCl_3$ gas bubbles.

Recently, however, in the light of harm of chlorine gas or contribution thereof to generation of dioxin, the following method has been adopted: the method of injecting a chlorine-based flux together with an inert gas as a carrier gas, instead of chlorine gas, into the molten Al to promote the removal of gas and slag from the melt.

In the case that the main substance for the refining treatment for removing $H_2$ gas and the inclusions from the melt was chlorine gas until then, the flux used in the refining was used as a substitute for chlorine gas and was mainly used in order to promote the removal of the gas or the removal of the slag from the melt surface after the removal of the inclusions from the melt. The slag-removing step is performed in the light of the following. Oxides containing impurities produced by the refining float up to the melt surface and are present as slag. As the refining advances, the amount of the slag increases. If the slag is allowed to stand as it is, the slag is redissolved into the melt or taken into the melt so that the slag may pollute the melt. The slag-removing step is performed to remove this slag from the melt or the melting furnace. As such a flux for moving the slag, Japanese Patent Application Laid-Open (JP-A) No. 61-243136 discloses a mixture flux which comprises, as main components, a chloride such as KCl and a fluoride such as $AlF_3$; and, as combustion improvers for heating, sulfate such as potassium sulfate, carbonate or nitrate. In this flux, 20–50 parts by weight of the combustion improvers are added to 100 parts by weight of the main components. Japanese Patent Application Laid-Open No. 1-123035 discloses a mixture flux comprising, as a main component, KC1; and, as combustion improvers for heating, potassium sulfate, potassium nitrate and Al atomizing powder.

The reason why these fluxes are mixtures or composites comprising the above-mentioned chloride is as follows. The melting point (decomposing point) of the chlorides that are main components for refining treatment for removing gas such as $H_2$ and inclusions from molten Al is higher than that of the molten Al. Thus, even if chlorides alone are injected into the molten Al, they are not easily decomposed so that the molten Al cannot be efficiently refined. For this reason, there is adopted a manner of adding the above-mentioned fluoride or the like to the chloride so as to produce mixture or composite compounds having a lower melting point. According to this manner, the mixture or composite compounds are easily decomposed in the melt. There is also adopted a manner of adding Al powder or the like thereto, so as to generate heat for easy decomposition.

These fluxes containing the above-mentioned chloride have less serious problems than chlorine gas. However, there arises a problem that the chloride is decomposed to produce chlorine gas. Thus, a non-halogen based flux for refining has been demanded. As this non-halogen based flux, Japanese Patent Application Laid-Open No. 7-207358 discloses a mixture flux comprising as a main component potassium sulfate ($K_2SO_4$) to which a lithium (Li) or magnesium (Mg) compound is added to lower the melting point of the sulfate.

In Japanese Patent Application Laid-Open No. 7-207358, potassium sulfate, lithiumborate or the like for dehydrogenation is used. However, the melting point of potassium sulfate or lithium borate is higher than that of Al; therefore, it is recognized that reaction for the dehydrogenation advances as gas-solid reaction so that the efficiency of the dehydrogenation reaction drops. Therefore, in order to lower the melting point of potassium sulfate or lithium borate, the mixture flux to which lithium sulfate, magnesium sulfate or the like is added is used. The mixture flux having a lowered melting point is molten in the melt, so as to make the flux into a liquid state. In this way, the reaction of this liquid with hydrogen in the melt is advanced as gas-liquid reaction. The produced hydrogen is gasified or removed as slag to perform dehydrogenation. In this prior art, the potassium sulfate content is preferably set to 60–99 wt. % (% by weight). This is based on the following reason. At the time of injecting the mixture flux whose melting point falls to about the temperature of molten Al, together with an inert gas as a carrier, into the melt, it is necessary to prevent melting of the flux at the tip of an injecting nozzle and filling in the nozzle.

This non-halogen based flux for refining makes it possible to prevent the above-mentioned problems based on use of chlorine or the chloride. However, there remains a problem that according to this flux the important efficiency of the refining, such as removing $H_2$ gas or inclusion from the melt, is poorer than according to the chlorine or chloride based flux.

Incidentally, in the field of Al alloy products, demands for the following are increasingly becoming strict: surface properties (such as surface flatness and surface roughness) of Al alloy products for use as electric/electrical parts, such as a disc substrate of a magnetic disc, a printing plate, or A photosensitive drum; and qualities (such as strength, formability and corrosion resistance) of Al alloy products for use as packaging containers such as a can, transporting means such as an automobile, or fabrics. With this, therefore, it is increasingly becoming necessary to reduce, to a greater extent, impurities such as $H_2$ and inclusions in Al alloy ingots.

Melting Al raw materials are changing from conventional Al base material to scraps of Al alloy products from the viewpoint of a social demand of establishing the recycling system of scrap of Al alloy products. As a result, 100% of Al raw material results from scrap in some case. However, in the case that Al products are made into scrap, the amount of impurity elements or gas components, such as $H_2$, which are incorporated from the scrap, increases unavoidably even if the scrap is subjected to pre- treatment. In the present situation, therefore, the scrap of Al alloy products is used as a melting raw material only for casting products. The scarp is partially used as a melting raw material for extension products such as sheets, plates and shapes, which are produced by rolling, extrusion or the like. In order to use the scrap of Al alloy products as a main melting raw material for extension products, it is becoming necessary to reduce impurities such as $H_2$ and inclusions in Al alloy ingots. If the reduction in the impurities becomes possible, there is established a complete recycling system for scrap of Al alloy extension products, in which the Al alloy extension product scrap is used as a melting raw material of Al alloy products. Thus, social significance is great.

In the present situation, however, a refining and non-halogen based flux which responds to the above-mentioned necessity and has refining efficiency equal to that of the chlorine or chloride based flux has not been made practicable in the Al alloy refining field. If refining for removing gas or inclusions at a high level is attempted to be performed, it is unavoidable to use the chlorine or chloride flux together with the existing non-halogen based flux.

For this reason, the inventors suggested a flux composed of only potassium sulfate as a refining flux for removing gas and slag from molten Al in Japanese Patent Application No. 10-125978. The subject matter of the invention is that the flux is not a mixture or composite flux, to which a compound for lowering the melting point of potassium sulfate, such as a compound of Li or Mg, is added, but is a flux composed of only potassium sulfate, thereby removing gas and inclusions from molten Al at a high level, that is, refining molten Al sufficiently.

However, in the case that this non-halogen based flux, together with an inert gas as a carrier gas, is injected into molten Al in order to apply this flux to actual refining of the molten Al, there arises a problem that a slight amount of potassium sulfate remains in the melt. That is, the refining ability of potassium sulfate to remove gas and inclusions is high but a part of potassium sulfate injected to molten Al is not decomposed and remains in the melt. This is because the decomposing temperature of potassium sulfate or sublimating temperature is slightly higher than the temperature of the molten Al.

If the potassium sulfate remaining in the melt is carried in an ingot, the potassium sulfate becomes an inclusion to lower the cleanness and quality of the ingot. However, if the temperature of the melt is raised or the melt is stirred for a longer time after the addition of the potassium sulfate, the remaining potassium sulfate is decomposed and lost.

From the viewpoint of economy and saving energy, however, essential in the steps of melting, refining and casting of Al alloy is the condition that its melting temperature is not raised, or refining time is not prolonged. It is therefore difficult to make potassium sulfate practicable as a refining flux because there arises a problem that potassium sulfate remains in the melt.

SUMMARY OF THE INVENTION

In the light of such situations, an object of the present invention is to provide a non-halogen based flux which makes it possible to reduce or remove gas and inclusions at a high level in refining and is free from a problem that the flux remains in melt; and a method for refining molten Al alloy, using this flux.

In order to attain this object, the subject matter of the method for refining molten Al alloy according to the present invention is that at the time of adding a refining flux to the molten Al alloy, the alloy obtained by melting an Al raw material, refining the molten Al alloy, and then casting the Al alloy, alum is used as the refining flux.

The subject matter of the flux for refining molten Al alloy according to the present invention is a refining flux for removing gas and slag, the flux being mainly composed of alum.

As non-halogen based fluxes for refining, the inventors researched substances which have a sublimating temperature lower than the temperature of molten Al and are superior in effect of removing gas and slag. As a result, it has been found that alum satisfies the above-mentioned flux-properties, the alum being widely used asa moisture absorbent, a food additive for improving a color tone of foods such as pickles, preserving them or preventing discoloration thereof, a fixer in the photographic field, a leather tanning agent, an admixture for concrete, a water cleaning agent, medicines, cosmetics, pigment, deodorant, a artificial jewel, new ceramics or the like.

Alum is a general term of double salts of sulfates of a trivalent metal ($R^3$) and a monovalent metal ($R^1$), represented by such a general formula as $R^3R^1(SO_4)_2.nH_2O$ (n=12, 10, 6, 4, 3, 2 or 0) or $R^1[R^3(H_2O)_6](SO_4)_2.nH_2O$. The trivalent metal ($R^3$) may be Al, Fe or Cr. The monovalent metal ($R^1$) may be K, $NH_4$ or Na. Typical examples of alum are potassium alum ($AlK(SO_4)_2.nH_2O$) and ammonium alum ($AlNH_4(SO_4)_2.nH_2O$). Ammonium alum is thermally decomposed into Al oxide ($Al_2O_3$). Thus, it is used as an artificial jewel or new ceramics.

Alum has the property that it is heated to start emitting SOx such as sulfurous acid gas (SO) or $SO_2$ from about 650° C., which is lower than the temperature of molten Al alloy, and is heated at about 950° C. to finish the thermal decomposition and produce Al oxide, although the details of this property are however different dependently on sorts of alum. At the heating temperature of 400–500° C., for example, ammonium alum and potassium alum emit ammonium sulfate and potassium sulfate, respectively.

The emitted sulfate or the emitted SOx gas is reacted with hydrogen in molten Al to have dehydrogenation function. The temperature of molten Al alloy is about 700° C. At temperatures below the temperature of the melt, alum as a flux added or injected to the melt causes sulfate or SOx gas such as $SO_2$ to be emitted. Fumes (particles) of the sulfate or SOx gas is reacted with hydrogen, in the form of solid-gas reaction or gas-gas reaction, in the melt. By gasifying the resultant hydrogen compounds or removing the compounds as slag from the melt, hydrogen can be removed from the melt. Moreover, the change of inclusions to slag is promoted and removal of the slag from the surface of the melt is also promoted. Such effects of cleaning the melt are produced.

More specific effect is as follows. The generated SOx gas is promptly diffused in the molten Al by bubbling effect of an inert gas so that gas bubbles of the SOx take in $H_2$ gas in the melt by diffusion and partial pressure equilibrium. The fine SOx gas bubbles float up to the surface of the melt and volatilize. The inclusions in the melt float from the inside of the melt to the surface thereof by bubbling effect or floating effect of the generated SOx gas or the inert gas.

The generated fumes diffuse promptly in the melt so that the fumes are reacted with hydrogen, in the form of gas-solid reaction. In this way, a hydrogen compound is produced or the alum is decomposed to produce SOx gas so that the fumes exhibit the same effect of removing gas and inclusions as the generated SOx. Such composite or synergetic effects, therefore, causes enhancement in the effect of removing gas components such as $H_2$ in the melt and especially inclusions of oxides.

The emitted sulfates and SOx have no less excellent effect of removing slag than conventional potassium sulfate or chloride-based fluxes. That is, alum as a flux has slag-removing effect of lowering wettability between molten Al and slag in the surface of the molten Al to promote the separation of the two. This effect is caused by oxidation of Al which is a little included in the slag. The oxidation is caused by exothermic reaction of the alum. This effect is further enhanced to produce a higher effect of refining the molten Al.

The temperature of the generation of Al oxide, which is an impurity or an inclusion harmful for the melt, is about 950° C. Accordingly, the generation temperature is far higher than the temperature of the molten Al alloy, that is, about 700° C. As a result, Al oxide is seldom generated upon actual refining of the melt. The temperature at which sulfate or SOx gas is emitted is far lower than the temperature of the molten Al alloy, that is, about 700° C., as described above. Alum is completely decomposed at this temperature of the molten Al alloy. Therefore, alum that is added or injected as a flux to the melt seldom remain as Al oxide or sulfate in the melt. Even if the Al oxide is produced in the melt, particles of the produced Al oxide is far finer than those of Al oxide produced by contact of the molten Al with the atmosphere. Thus, the Al oxide produced in the melt floats easily from the inside of the melt to the surface thereof by bubbling effect or floating effect of the generated SOx gas or the inert gas, to promote the conversion thereof to slag and remove the slag. Accordingly, the produced Al oxide seldom remain in the melt.

Therefore, alum as a flux does not remain in the melt, and has an excellent effect of removing hydrogen and inclusions from the melt. Concerning ammonium alum $AlNH_4(SO_4).nH_2O$, however, $NH_4$ may be decomposed to produce hydrogen under some refining condition and stirring by the inert gas for removing hydrogen may be prolonged because of the residual hydrogen in the melt. It is therefore preferable to use potassium alum $AlK(SO_4)_2.nH_2O$, which has such a side effect as above. The alum referred to in the present invention includes not only the above-mentioned specific examples but also all compounds that are classified into the class of alum, emit sulfate or SOx gas for dehydrogenation, and generate no remaining impurities harmful for the melt.

The inventors researched examples of use of alum. Alum is widely used in various fields, but the inventors found no examples wherein alum is used as a flux for refining molten Al alloy. The numerous examples of use of alum are examples wherein various properties of alum are used at room temperature or alum is used as a raw material for obtaining Al oxide by complete decomposition thereof. From these technical ideas, so far as the ideals do not combine with ideas about refining of molten Al alloy, it is difficult to acquire the idea of using the high-temperature property of alum, specifically the property that sulfate or SOx gas is emitted as an intermediate product until alum is completely decomposed to produce Al oxide, and using alum as a flux for refining molten Al alloy. Therefore, there would not be examples of use of alum concerned with the present invention.

DETAILED DESCRIPTION OF THE PREFERRED EMBODIMENTS

The significance of the respective requirements of the present invention will be described hereinafter.

The wording "alum is used as a non-halogen based, refining flux and the flux is mainly composed of alum" in the present invention means that alum only (100% alum) is used or alum may be used in the manner that alum is combined or blended with another or other flux(s).

As described above, the alum flux of the present invention has both effect of removing hydrogen and inclusions in melt and effect of removing slag. Moreover, alum itself is more inexpensive than conventional fluxes. From these properties of alum, alum only may be used. However, various refining fluxes have functions other than functions of removing hydrogen and inclusions and of removing slag. In order to satisfy the other functions, alum may be combined or blended with another or other flux(es).

Examples of the other fluxes include (1) sulfates such as potassium sulfate ($K_2SO_4$), sodium sulfate ($Na_2SO_4$), calcium sulfate ($CaSO_4$) and ammonium sulfate, and carbonates and nitrates corresponding thereto, as an flux for removing hydrogen and inclusions in melt, or a combustion improver for heating, (2) chloride such as KCl and fluoride such as $AlF_3$ as an flux for removing hydrogen and inclusions in melt, (3) Al atomizing powder and nitrates such as potassium nitrate a combustion improver for heating, and (4) lithium (Li) compounds such as lithium borate, and magnesium (Mg) compounds, as an agent for lowering the melting point of sulfates. These may be added in an amount of 10–90 wt. % to the alum referred to in the present invention to yield a mixture flux. However, in order to prevent of generation of chlorine, the use of chlorides such as KCl should be avoided as much as possible.

The injecting or adding amount of the alum flux of the present invention to molten Al is decided on the basis of necessary refining amounts such as removing amounts of gas, inclusion and slag from the molten Al. In order to respond to demands of properties in the fields of electric and electrical parts, transportation means such as automobiles, and fabrics, which are field in which Al alloy products are used, it is preferable to set the amount of $H_2$ in a molten Al ingot to 0.25 cc/100 gAl or less, and set the amount of oxide inclusions such as alumina ($Al_2O_3$) magnesia (MgO) and spinel (composite oxide of Mg and Al) to 200 ppm or less therein. The amount of above-mentioned three-type oxides, $Al_2O_3$, MgO and spinel, are more than the amount of the other oxides in the molten Al. The measurement of the amount of the three-type oxides is easier than the measurement of the other oxides. Therefore, the expression "the amount of oxide inclusions" in the present invention means the total amount of the three-type oxides, $Al_2O_3$, MgO and spinel. In order to carry out refine at such a level, it is preferable that the injecting or adding amount of the alum flux in molten Al is 1–0.01 mass % by weight of the molten Al. If the injecting or adding amount of the alum flux is less than 0.1 mass %, gas and inclusions cannot be removed up to the above-mentioned level. If this amount is more than 1 mass %, refining effect is not improved so that costs for the refining rise. Besides, the melt may be polluted.

The alum flux is added to melt by injection thereof into the melt, spray thereof onto the surface of the melt, or the like. The injection is the same method for conventional refining fluxes. It is preferable for refining efficiency to inject powder of alum together with an inert gas such as $N_2$ or Ar gas as a carrier into molten Al from a nozzle or a lance inserted into the molten Al. The inert gas such as $N_2$ or argon gas, together with the carrier for the alum flux, causes to bubble the melt, so as to promote refining effect of alum and floating of slag inside the melt. The inert gas plays such an important role. Of course, in order to enhance the bubbling effect of the melt, it is allowable to inject the inert gas through the same lance as for the carrier or a different lance during or after the injection of the flux. Besides such injection, the flux may be sprayed onto the surface of the melt. In short, a preferable method for improving refining effect may be appropriately selected.

The preferable grain diameter or the grain size of the alum powder may be appropriately selected. However, alum has moisture absorption; therefore, it is preferable to prevent obstruction of the injection or addition of the flux, such as filling in the lance for injecting the flux. In the case of using alum which has absorbed moisture, water from the absorbed moisture is incorporated into the melt and harmful hydrogen as an impurity may remain in the melt. In connection with this point, in order to use alum in a dry state, it is preferable to use, for example, a manner of heating alum just before the use thereof and drying it.

Refining of the melt containing the alum flux of the present invention is preferably performed at least in a melting surface. This is because refining of any melt, such as injection of a flux, has been hitherto performed mainly in a melting furnace and the melting furnace has a design or a structure which easily enables refining and slag-removal, which is integrated with the refining, after the refining. Therefore, the present invention has an advantage that existing facilities are used as they are in the case of performing the present invention in a melting furnace. of course, with or without the refining in the melting furnace, refining by use of alum as a flux may be performed in a holding surface or launders subsequent to the melting furnace. In many cases, however, the holding furnace and the launders originally do not have facilities for refining or removing slag. Since it is unnecessary to provide such facilities newly or existing facilities are used as they are, it is advantageous to perform refining in the melting furnace.

The inventors have found the following. At the time of transferring the refined molten Al from the melting furnace to a launder and then injecting an inert gas into the molten Al flowing down through the launder to remove gas (i.e., perform gas-removing refining) from the molten Al, the efficiency of the gas-removing refining drops in the conventional SNIF (Spinning Nozzle Inert Flotation) manner (that is, the manner of disposing a melt pool in the form of a culvert at a launder to prolong reaction time of an inert gas and thus lower the flow speed of melt, and injecting the inert gas in the melt pool) drops. It has also been found that the following manner has a greater gas-removing refining effect on melt than the SNIF manner: the manner of using a launder having no melt pool in the form of a culvert and injecting, for flowing-down melt, an inert gas into the bottom portion of the launder.

In a preferable embodiment of the present invention, therefore, at the time of transferring molten Al refined with the alum flux from the melting furnace into a launder and then supplying the molten Al through the launder into a mold, an inert gas is injected into the molten Al flowing down from the launder to remove gas from the molten Al.

In order to ensure the requirement that the amount of $H_2$ in an Al alloy ingot is 0.25 cc/100 gAl or less and the amount of oxide inclusions is 200 ppm or less in the present invention, molten Al is preferably subjected to gas-removing refining. That is, it is preferable to transfer the molten Al refined with the alum flux from the melting furnace, with or without the passage thereof through a holding furnace, into a launder, and injecting an inert gas (without a flux) into the melt flowing down through the launder so as to subject the melt to gas-removing refining. It is important in the refining of the melt in the launder that the inert gas is injected to the melt flowing down through the launder by inserting a lance or a stirring fan (with a gas passage) from just-above the melt into the melt flow, especially into the bottom portion thereof. When the inert gas is injected into the bottom portion of the melt flow, the injected inert gas is promptly diffused in many directions inside the melt flow, for example, in the upper, lateral and oblique directions inside the melt flow by kinetic energy of the melt flow. Thus, the bubbling effect and gas-removing effect on the melt are enhanced. That is, in the gas-removing refining in the present invention, the step of emitting bubbles of the inert gas filled with $H_2$ gas out of the melt by diffusion (i.e., the step of promoting material-movement) is the rate-determining step of gas-removing reaction.

On the other hand, according to the conventional SNIF manner, that is, the manner of disposing a melt pool in the form of a culvert at a launder and injecting an inert gas into the melt whose flow is weakened in the melt pool, even if the inert gas is injected to the bottom portion of the melt (the melt pool), the injected inert gas rises only in the upper of the melt flow. Thus, the above-mentioned diffusion does not arise so that the babbling effect and the gas-removing effect drop. This is because in the gas-removing refining in the conventional SNIF manner the time of reaction between the melt containing $H_2$ gas and the inert gas bubbles is the rate-determining step of gas-removing reaction. In the present invention, therefore, any melt pool in the form of a culvert is not disposed at launders and the inert gas is injected into the melt naturally flowing down in a launder.

Upon the injection of the inert gas, it is preferable for great dehydrogenation effect to use not a cylindrical nozzle or lance but a gas-injecting device having rotating fans. This gas-injecting device having rotating fans is a device in which the rotating fans are fitted to the tip of a nozzle or a lance and an inert gas supplied through the nozzle or the lance is made into fine bubbles by means of the rotating fans. More specifically, this device is composed in such a manner that, for example, rotating fans (4 fans) in a cross shape are fitted to the tip of a cylindrical nozzle or lance and an inert gas is injected through slits made in the rotating fans. By the rotating driving of the nozzle or the lance, the rotating fans themselves are rotated in the melt, so as to generate bubbling effect on the melt and shear the inert gas injected through the slits into the melt by the rotating power of the rotating fans.

In this way, the inert gas is made into fine bubbles so that the babbles float or move.

The inert gas can be made into bubbles having a diameter of 1 mm or less by means of the gas injecting device having rotating fans. As the number of the rotating fans, the shearing force by the rotating fans is larger so that the melt can be more stirred or the inert gas bubbles can be made finer. Therefore, in the case that the diameter of the rotating fans is from 100 to 400 mm, the rotating number of the rotating fans is preferably at least 200 r.p.m. However, if the rotating number is over 800 r.p.m., the melt flow itself in the launder may be disturbed. Thus, the rotating number of the rotating fans is preferably from 200 to 600 r.p.m., and more preferably from 250 to 350 r.p.m. The number of the fans is preferably larger in order to increase the shearing force and make the diameter of the bubbles finer. From the standpoint of strength and fabrication of the fans, however, 4 fans (cross-shaped fans) are preferable. The nozzle and the rotating fans are preferably composed of graphite or a ceramic such as SiC, or a mixture or composite of such ceramics, which has heat resistance and strength, in order to resist the temperature of the melt and heat impact from high-speed rotation.

In order to ensure the fact that the amount of oxide inclusions such as alumina in the Al alloy ingot is set to 200 ppm or less in the present invention, the inclusions are preferably removed by filtering the melt through a filter at the time of supplying the melt through the launder to a mold. As this filter, any know filter may be used. It is however preferable to use a filter which has high heat resistance and strength to resist the temperature of melt and heat impact, for example, a filter made of a ceramic such as alumina, muraite or silicon carbide. The filter is preferably a porous body having a shape such as a noodle, a honeycomb or a tube.

The filter for removing the inclusions has been fitted from previous times. As described above, the non-halogen based flux has a poorer performance of removing the inclusions in the melting furnace than the chlorine or chloride based fluxes. Thus, the amount of the inclusions in the melt increases inevitably. Therefore, in the case of filtering the melt through the heat-resistant filter made of a porous ceramic and fitted to the launder to remove the inclusions, the filling in pores or meshes of the filter occurs easily if the pores or meshes are relatively fine. Accordingly, there arises a problem that the efficiency of melting and casting is lowered by the exchange of the filter and melting casts are raised. On the other hand, according to the present invention, the load against the ceramic filter fitted to the launder is highly reduced since the performance of removing the inclusions in the melting furnace is removed. Therefore, the following is also is improved: the efficiency of removing, through the filter, the inclusions that has not been removed by refining in the melting furnace. The filling in the filter is reduced to prolong the lifetime of the filter because the load against the filter by the inclusions is highly reduced. As a result, there is sufficiently solved the problem that the efficiency of the melting and costs are reduced by the exchange of the filter or melting casts are raised.

The Al alloy that is a subject of refining according to the present invention is not especially limited. For example, the present invention may be widely applied to pure Al according to AA or JIS 1000 series or Al alloys such as of 2000, 3000, 4000, 5000, 6000, 7000 series alloys and the like. The method of the present invention may be used together with other refining methods for removing metallic impurities such as Pb, Ti, Sn and Fe.

The Al raw material that is a subject of the refining of the present invention is preferably raw material composed mainly or wholly of scrap of an Al alloy product, which contains a large amount of impurities, since the refining effect of the present invention can be sufficiently exhibited. Of course, Al base metal can be used as a melting raw material in accordance with required quality of cast Al alloy products. The Al base metal may be used together with the scrap. If the scrap, which is more inexpensive than the Al base metal, is used as the melting raw material, costs can be lowered. A great social significance of recycling of the scrap can be attained.

EXAMPLES

The following will describe Examples of the present invention. Various Al alloys of 2000 to 7000 series were melted, refined and cast. In the melting, Al alloy raw materials were melted under atmosphere at 750±+10° C., in a high-frequency induction melting furnace to adjust the materials into the compositions of respective Al alloys. The amounts of the impurities in the molten Al at this time (i.e., before refining in a melting furnace) were according to analysis of the melts by the partial pressure equilibrium method and results of analysis of solidified Al after cooling the melts. Analysis of hydrogen was according to Ransley method. The amount of oxide inclusions was according to the Br-methanol method. Analysis methods were the same in analysis referred to hereinafter. In the respective melts, the amounts of hydrogen and oxide inclusions were 0.4–0.3 cc/100 gAl and 400–300 ppm, respectively.

Thereafter, the melts in the melting furnace were refined with fluxes and chlorine gas shown in Table 1. Alum used in the examples is potassium alum ($AlK(SO_4)_2$). In the refining with the fluxes in each of the examples, lances for injection, each of which was composed of an iron pipe and inserted into the melt, were used, and the injected amount of $N_2$ gas as a carrier gas was set to 20 Nl/minute. Each of the fluxes was injected in an amount of 0.1 mass % of each melt into the melt. Thereafter, $N_2$ gas was bubbled for 30 minutes to remove hydrogen gas and inclusions. Chlorine gas was injected through the lance to the melt in an amount of 300 Nl/minute for 15 minutes. Thereafter, N2 gas was bubbled for 30 minutes. During the refining treatment, slag in the surface of the melt was continuously removed in each of the Examples and Comparative Examples shown in Table 1.

In each of Examples and Comparative Examples, the refined melt was transferred to alaunderby slanting the melting furnace. The length of the launder was about 1 mm. The speed of the melt flowing through the launder (melt speed) was 5 t/hour. The depth of the melt flow in the launder was 0.6 m. The temperature of the melt was from 730 to 740° C. The lances were inserted, at an interval, into the bottom portion of the melt in the launder at the point of 0.5 m before a mold. $N_2$ gas was injected in the launder to refine the melt in the launder. $N_2$ gas was injected at an average injected amount of 20 Nl/minute from the initial point to the finish point of the melt flow, at which the $N_2$ gas was able to be injected. In the injection of $N_2$ gas, there was used a rotating-fan-type gas injecting device having a nozzle (diameter: 100 mm), the tip of which had 4 rotating fans. The fans was cross-shaped and had slits. The fans was immersed and arranged in the bottom portion of the melt flow (just above the launder). The rotating number of the fans was set to 300–320 r.p.m. to make the diameter of bubbles of the inert gas to 1 mm or less.

A filter (trade name: Actothermic, made by Kobe Steel Ltd.) composed of a noodle-form porous body (thickens: 50 mm) made of alumina was disposed at a launder portion of 0.2 m before the mold, and the melt was filtered to remove inclusions. Thereafter, the melt was supplied to the mold through the launder to produce an Al alloy ingot by DC casting (semi-continuos casting). The amount of $H_2$ in the produced Al alloy ingot and the amount of oxide inclusions therein, were measured. The ingots having an $H_2$ amount of 0.4 cc/100 gAl or more, 0.4–0.25 cc/100 gAl, and 0.25–0.1 cc/100 gAl were represented as x, Δ, and ○, respectively. All of the ingots represented as ○ had an $H_2$ amount of 0.12.–0.1 cc/100 gAl. The ingots having an amount of oxide inclusions of 200 ppm or more, 200–100 ppm, and 100 ppm or less were represented as x, Δ, and ○, respectively. These results are also shown in Table 1.

About the ingots to which the flux was added, the decomposition product of the added flux was presumed as sulfate, and the amount of the sulfate in the ingots was analyzed as the S content therein. This S content was estimated as the amount of remaining impurity in the melt. The ingots having a decomposition product amount of 20 ppm or more, 20–5 ppm, and 5 ppm or less were represented as x, Δ, and ○, respectively.

As shown in Table 1, in all Examples 5, 6 and 7 using the alum flux, the amounts of impurities in the Al alloy ingots were as follows in spite of the kinds of all alloys and relatively small used amounts of the flux (i.e., 0.1 mass % in the molten Al). The amount of $H_2$ was 0.25 cc/100 gAl or less and the amount of oxide inclusions was 100 ppm or less. That is, the amounts of the impurities were reduced up to a low level. These results were the same level as Comparative Example 10, wherein $Cl_2$ gas was used for refining. The amounts of the remaining impurities were so little as to be allowed, or substantially zero. These effects cannot be attained if slag-removing effect is low. Thus, the flux of the present invention has a high slag-removing effect. Therefore, it was supported that the refining effect of the flux of the present invention is as high as that of the method of using $Cl_2$ gas.

Examples 1 and 3, wherein refining was not perfumed in the launder, had a higher hydrogen amount in the Al alloy ingots than other Examples. Therefore, the effect of the refining in the launder was supported. Examples 1 and 4, wherein inclusions were not removed from the melts with the filter, had a higher inclusion amount in the Al alloy ingots than other Examples. Therefore, the effect of removing the inclusions with the filter was supported.

On the other hand, Comparative Example 8, which used 100% $K_2SO_4$ and corresponded to Japanese patent Application No. 10-125978, had as high refining effect as the present invention, but contained large amount of the remaining impurities in the melt. In Comparative Example 9 using a flux which was composed mainly of a halogen-based chloride, KCl and a fluoride, $AlF_3$, and with which $K_2SO_4$ was blended, the amounts of the impurities ($H_2$ and oxide inclusions) in the Al alloy ingot were lower than the initial amounts of the impurities in the Al alloy melt before refining in the melting furnace, but the effect of reducing the impurities from the Al alloy ingot was poorer than in Examples and Comparative Example 10 using $Cl_2$ gas for refining. In spite of the refining in the launder and the removal of the inclusions from the melt with the filter, the refining effect by the flux in the melting furnace was poorer than the in Examples and Comparative Example 10 using $Cl_2$ gas for refining.

As described above, according to the refining method and the flux for refining according to the present invention, upon producing an Al ingot, it is possible to raise the refining effect and the refining efficiency in a melting furnace, remove simultaneously hydrogen and oxide based inclusions from the Al alloy ingot, and reduce the amounts thereof to a low level. Moreover, a part of the flux injected into molten Al or a decomposition product does not remain the melt. It is therefore possible to raise sufficiently the quality of Al alloy products, such as sheets and plates, shapes, wire rods, and rods, produced from this ingot and enlarge the use of Al alloy. Additionally, scrap of Al alloy products can be mainly used as a melting raw material of Al alloy extension products. Thus, social significance such as establishment of the recycling system of the scrap can be attained.

TABLE 1

| Example No. | Example or Comparative Example | Cast Al alloy | Composition of fluxes (weight %) | Refining in a launder | Filter for filtration | Quality of Al alloy ingots: Remaining impurities | Quality of Al alloy ingots: $H_2$ amount | Quality of Al alloy ingots: Oxide inclusions amount |
|---|---|---|---|---|---|---|---|---|
| 1 | Example | 2017 | Alum 100% | Not done | Not used | ○ | Δ | Δ |
| 2 | Example | 3004 | Alum 95% + $K_2SO_4$ 5% | Done | Used | ○ | ○ | ○ |
| 3 | Example | 3004 | Alum 100% | Not done | Used | ○ | Δ | ○ |
| 4 | Example | 3004 | Alum 50% + $K_2SO_4$ 50% | Done | Not used | ○ | ○ | Δ |
| 5 | Example | 5052 | Alum 95% + KCl 5% | Done | Used | ○ | ○ | ○ |
| 6 | Example | 6061 | Alum 95% + Al powder 5% | Done | Used | ○ | ○ | ○ |
| 7 | Example | 7075 | Alum 100% | Done | Used | ○ | ○ | ○ |
| 8 | Comparative Example | 3004 | $K_2SO_4$ 100% | Done | Used | X | ○ | ○ |
| 9 | Comparative Example | 3004 | $K_2SO_4$ 20% + KCl 50% + $K_3AlF_6$ 30% | Done | Used | ○ | X | Δ |
| 10 | Comparative Example | 3004 | $Cl_2$ gas 100% | Done | Used | ○ | ○ | ○ |

What is claimed is:

1. A method for refining Al alloy, the method comprising refining a melt by adding alum as a refining flux into a molten Al alloy obtained by melting an Al raw material.

2. The method according to claim 1, wherein the refining of the melt is performed at least in a melting furnace.

3. The method according to claim 1, wherein the alum, together with an inert gas as a carrier gas, is injected into the melt.

4. The method according to claim 3, wherein the injected amount of the alum is from 0.01 to 1 mass % of the melt.

5. The method according to claim 1, wherein the amounts of $H_2$ and oxide inclusions in the resultant Al alloy ingot are 0.25 cc/100 gAl or less and 200 ppm or less, respectively.

6. The method according to claim 1, wherein a part or the whole of the Al raw material is scrap of Al alloy products.

7. A method for refining Al alloy, the method comprising transferring a melt of a molten Al alloy, obtained by melting an Al raw material, from a melting furnace to at least one of a holding furnace and a launder;

refining the melt by adding alum to the molten Al alloy in at least one of the melting furnace, the holding furnace and the launder.

8. The method according to claim 7, wherein after the refining, an inert gas is injected into the melt in the launder to remove gas from the melt.

9. The method according to claim 7, wherein after the refining, the melt in the launder is subjected to filtration with a filter fitted to the launder.

10. The method according to claim 7, wherein the alum, together with an inert gas as a carrier gas, is injected into the melt.

11. The method according to claim 10, wherein the injected amount of the alum is from 0.01 to 1 mass % of the melt.

12. The method according to claim 7, wherein the amounts of $H_2$ and oxide inclusions in the resultant Al alloy ingot are 0.25 cc/100 gAl or less and 200 ppm or less, respectively.

13. The method according to claim 7, wherein apart or the whole of the Al raw material is scrap of Al alloy products.

* * * * *